US011054170B2

(12) United States Patent
Palle et al.

(10) Patent No.: US 11,054,170 B2
(45) Date of Patent: Jul. 6, 2021

(54) SYSTEMS AND METHODS FOR PROVIDING AIRFLOWS ACROSS A HEAT EXCHANGER

(71) Applicant: Johnson Controls Technology Company, Auburn Hills, MI (US)

(72) Inventors: Arun S. Palle, Hyderabad (IN); Pankaj B. Avhad, Nashik (IN); Dnyanesh C. Deshmukh, Satara (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 150 days.

(21) Appl. No.: 16/113,985

(22) Filed: Aug. 27, 2018

(65) Prior Publication Data

US 2020/0064015 A1 Feb. 27, 2020

Related U.S. Application Data

(60) Provisional application No. 62/722,686, filed on Aug. 24, 2018.

(51) Int. Cl.

| | |
|---|---|
| ***F24F 13/10*** | (2006.01) |
| ***F24F 1/38*** | (2011.01) |
| ***F24F 13/28*** | (2006.01) |
| ***F24F 11/871*** | (2018.01) |
| *F24F 140/40* | (2018.01) |
| *F24F 3/08* | (2006.01) |

(52) U.S. Cl.

CPC ..... *F24F 13/10* (2013.01); *F24F 1/38* (2013.01); *F24F 11/871* (2018.01); *F24F 13/28* (2013.01); *F24F 3/08* (2013.01); *F24F 2140/40* (2018.01)

(58) Field of Classification Search

CPC ..... F24F 13/1004; F24F 3/052; F24F 3/0522; F24F 11/81

See application file for complete search history.

(56) References Cited

U.S. PATENT DOCUMENTS

| | | | | |
|---|---|---|---|---|
| 4,044,947 | A * | 8/1977 | Spethmann | F24F 13/04 236/13 |
| 4,109,704 | A * | 8/1978 | Spethmann | F24F 3/0522 165/249 |
| 4,111,048 | A * | 9/1978 | Zuckerman | F24F 11/02 374/109 |
| 4,841,733 | A * | 6/1989 | Dussault | F24F 5/0071 62/93 |
| 5,117,899 | A * | 6/1992 | Skimehorn | F24F 3/052 165/119 |

(Continued)

FOREIGN PATENT DOCUMENTS

| | | |
|---|---|---|
| WO | 2016159857 | 10/2016 |

*Primary Examiner* — Nelson J Nieves

(74) *Attorney, Agent, or Firm* — Fletcher Yoder, P.C.

(57) ABSTRACT

The present disclosure relates to a heating, ventilation, and/or air conditioning (HVAC) system that includes a return air section of an HVAC unit configured to receive a return airflow from a conditioned space. The HVAC system also includes an outdoor air section of the HVAC unit configured to receive an outdoor airflow from an environment surrounding the HVAC unit. Furthermore, the (HVAC) system includes a panel dividing the return air section and the outdoor air section. The panel includes a bypass damper actuatable to enable mixing of the return airflow and the outdoor airflow to produce a mixed airflow in the outdoor air section.

25 Claims, 7 Drawing Sheets

(56) References Cited

U.S. PATENT DOCUMENTS 5,564,626 A * 10/1996 Kettler ..... F24F 3/044 236/49.3
6,386,281 B1 * 5/2002 Ganesh ..... F24F 3/1405 165/252
6,427,454 B1 * 8/2002 West ..... F24F 3/153 62/93
9,612,024 B2 4/2017 Rohde
9,631,834 B2 * 4/2017 Uselton ..... F24F 13/30
9,709,294 B2 * 7/2017 Elliott ..... F24F 3/1405
10,545,476 B2 * 1/2020 Elliott ..... F24F 11/30
2003/0199245 A1 * 10/2003 Akhtar ..... F24F 13/24 454/262
2005/0252229 A1 * 11/2005 Moratalla ..... B01D 53/26 62/271
2006/0130502 A1 6/2006 Wruck et al.
2013/0320573 A1 * 12/2013 Fisher ..... F24F 11/77 261/128
2014/0199938 A1 * 7/2014 Badenhorst ..... E04F 17/04 454/342
2014/0338865 A1 * 11/2014 Ross ..... F24F 5/0035 165/104.34
2015/0114596 A1 * 4/2015 Rohde ..... F24F 13/10 165/59
2015/0114614 A1 * 4/2015 Troxell ..... F24F 11/70 165/250
2015/0204568 A1 * 7/2015 Thomas ..... F24F 13/10 62/127
2015/0354845 A1 * 12/2015 Brown ..... F24F 11/77 165/237
2016/0370029 A1 * 12/2016 Kurelowech ..... F24F 13/10
2017/0268797 A1 * 9/2017 Mowris ..... F24D 19/1084
2017/0307244 A1 10/2017 Elliot et al.
2018/0073756 A1 3/2018 Mikulica et al.
2019/0107310 A1 * 4/2019 Fiegen ..... F24F 3/044
2019/0368769 A1 * 12/2019 Hasegawa ..... F24F 13/20

* cited by examiner

SYSTEMS AND METHODS FOR PROVIDING AIRFLOWS ACROSS A HEAT EXCHANGER

CROSS-REFERENCE TO RELATED APPLICATIONS

This application is a U.S. Non-Provisional application claiming priority to and the benefit of U.S. Provisional Application No. 62/722,686, entitled "SYSTEMS AND METHODS FOR PROVIDING AIRFLOWS ACROSS A HEAT EXCHANGER," filed Aug. 24, 2018, which is hereby incorporated by reference in its entirety for all purposes.

BACKGROUND

The present disclosure relates generally to heating, ventilation, and air conditioning (HVAC) systems. A wide range of applications exist for HVAC systems. For example, residential, light commercial, commercial, and industrial HVAC systems are used to control temperatures and air quality in residences and other buildings. Certain HVAC units can be dedicated to either heating or cooling, although many HVAC units are capable of performing both functions. HVAC units may also provide ventilation to a conditioned interior space. In general, HVAC systems operate by implementing a thermodynamic cycle in which a refrigerant undergoes alternating phase changes to remove heat from or deliver heat to a conditioned interior space of a building. Heating may also be provided by heat pumps, gas furnace heat exchangers, electric resistance heat, or steam or hot water coils. Similar systems are used for vehicle cooling, and as well as for other types of general refrigeration, such as refrigerators, freezers, and chillers.

Certain HVAC systems may enable environmental air and return air to be conditioned and provided to a conditioned space as conditioned air. For instance, previously conditioned air may return to an HVAC unit from a conditioned space, and the HVAC unit may be configured to intake air from an environment in which the HVAC unit is positioned, such as an outdoor environment. To become conditioned air, the return air and the environmental air may both pass across a heat exchanger included in the HVAC system. However, in some cases, the return air and environmental air may be associated with specific portions or flow paths of the HVAC unit and/or the heat exchanger. Additionally, the amount of return air utilized to provide the conditioned air may differ from the amount of environmental air utilized to provide the conditioned air. As such, in certain cases, most of the airflow across the heat exchanger may occur at certain, limited portion of the heat exchanger, which can lead to a reduced heat exchanging capacity for the heat exchanger.

SUMMARY

The present disclosure relates to a heating, ventilation, and/or air conditioning (HVAC) system that includes a return air section of a (HVAC) unit configured to receive a return airflow from a conditioned space. The (HVAC) system also includes an outdoor air section of the (HVAC) unit configured to receive an outdoor airflow from an environment surrounding the (HVAC) unit. Furthermore, the (HVAC) system includes a panel dividing the return air section and the outdoor air section. The panel includes a bypass damper actuatable to enable mixing of the return airflow and the outdoor airflow to produce a mixed airflow in the outdoor air section.

The present disclosure also relates to a heating, ventilation, and/or air conditioning (HVAC) unit that includes a return air section that has a return air inlet configured to receive a return airflow from a conditioned space and a return air outlet configured to output airflow toward a heat exchanger of the HVAC unit. The HVAC unit also includes an outdoor air section that has an outdoor air inlet configured to receive an outdoor airflow from an environment surrounding the HVAC unit and an outdoor air outlet configured to output airflow toward the heat exchanger. Moreover, the HVAC unit includes a panel dividing the return air section and the outdoor air section. The panel includes a bypass damper actuatable to fluidly couple the outdoor air section and the return air section and enable mixing of the outdoor airflow and the return airflow within the outdoor air section, the return air section, or both, to produce a mixed airflow.

The present disclosure further relates to a heating, ventilation, and/or air conditioning (HVAC) unit that includes a pre-mixing section. The pre-mixing section has a return air section configured to receive a return airflow from a conditioned space. Additionally, the pre-mixing section has an outdoor air section configured to receive an outdoor airflow from an environment surrounding the HVAC unit. The HVAC unit also includes a panel disposed within the pre-mixing section and dividing the return air section and the outdoor air section. The panel includes a bypass damper actuatable to enable the return airflow to enter the outdoor air section, the outdoor airflow to enter the return air section, or both. Furthermore, the HVAC unit is configured to mix the return airflow and the outdoor airflow within the pre-mixing section to form a mixed airflow as well as provide the mixed airflow to the conditioned space.

DETAILED DESCRIPTION

HVAC systems may condition a combination of return air and outdoor air to generate conditioned air that is provided to a conditioned space. In particular, outdoor air may enter a portion an HVAC unit, return air from the conditioned space may enter a different portion of the HVAC unit, and the two portions of the HVAC unit may be physically and fluidly separated from one another by a physical barrier, such as a panel. In other words, the HVAC unit may include separate intakes for the return air and the outdoor air, where the separate intakes are physically separated by a panel or other barrier. As discussed herein, a bypass damper may be included on the panel. When opened, the bypass damper enables return air and outdoor air to mix with one another. For instance, return air may flow across the opened bypass damper and enter a portion of an HVAC unit configured to intake the outdoor air. In this manner, the return air and outdoor air are combined to form mixed air. The mixed return air and outdoor air may subsequently pass across a heat exchanger of the HVAC unit to heat or cool the mixed air before the mixed air is provided as conditioned air to the conditioned space. As discussed in greater detail below, by enabling the return air and outdoor air to mix upstream of the heat exchanger within the HVAC unit, the flow of mixed air may be distributed relatively evenly across the heat exchanger. In other words, the disclosed bypass damper may reduce concentrations of air flow passing across certain portions of the heat exchanger that can leave other portions of the heat exchanger underutilized. As discussed below, the improved distribution of mixed air flow across the heat exchanger may result in higher energy efficiency of the HVAC unit, smaller drops in pressure within the HVAC unit, and increased heating and cooling capacity of the heat exchanger.

Figure 1:
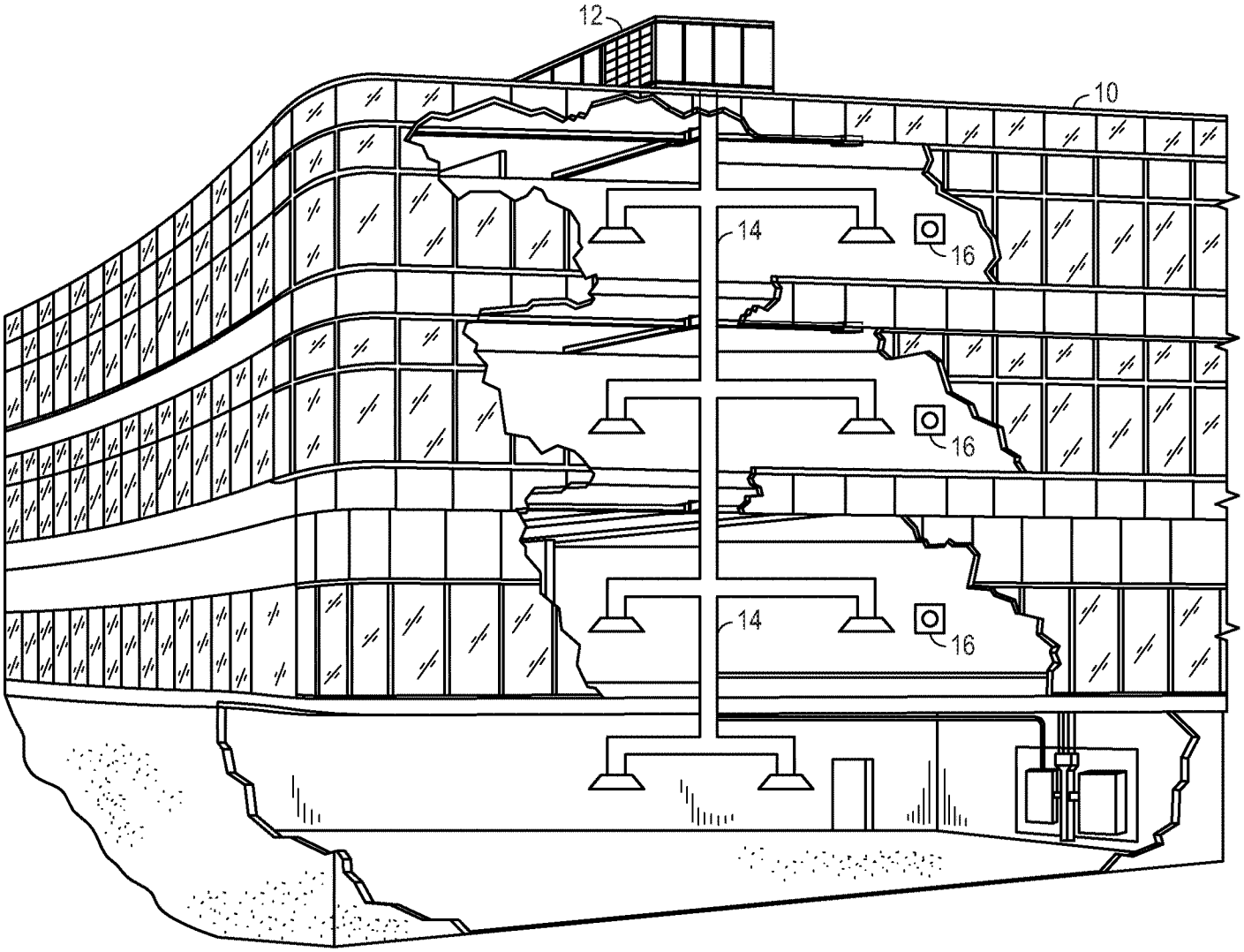
FIG. 1 is a perspective view an embodiment of a heating, ventilating, and air conditioning (HVAC) system for building environmental management, in accordance with aspects described herein.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
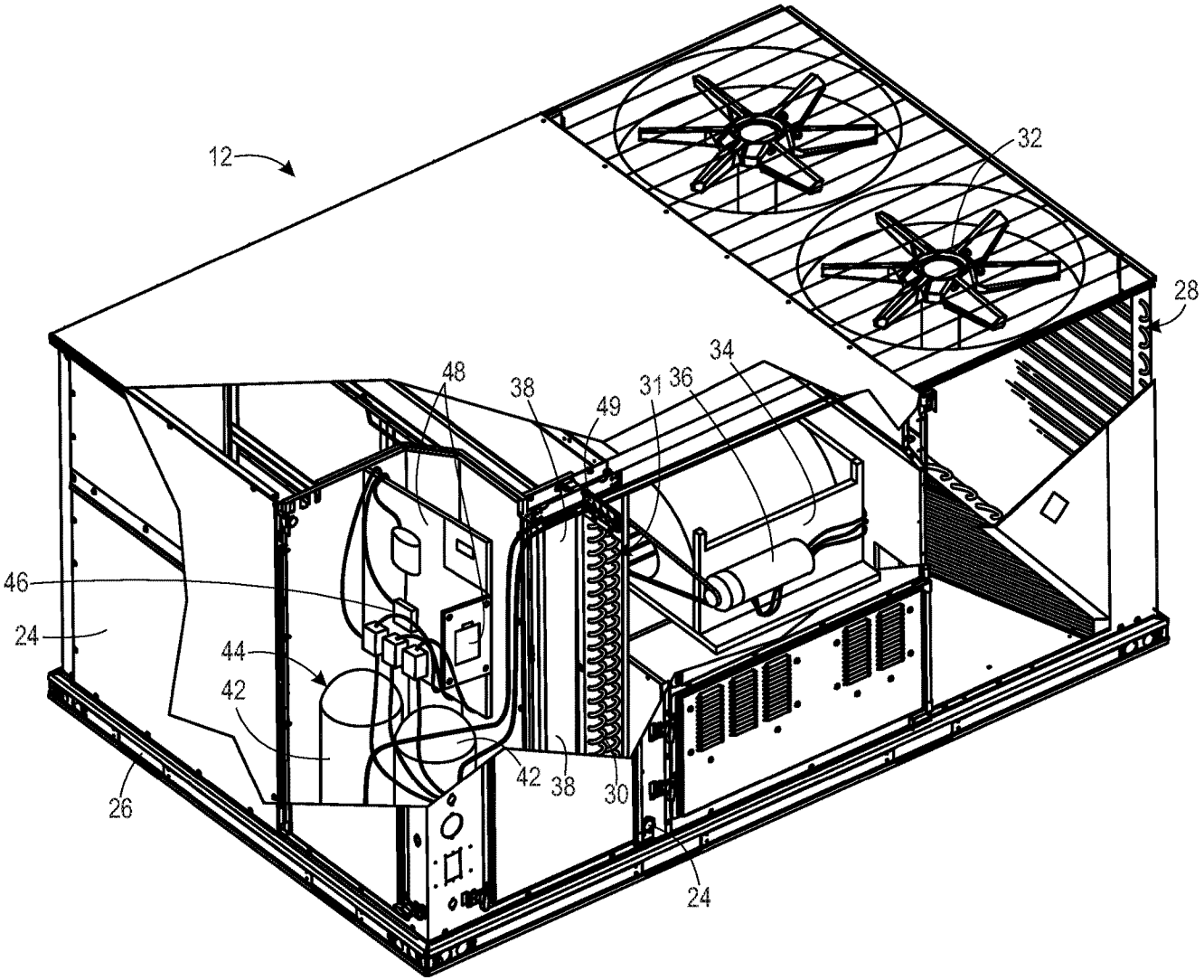
FIG. 2 is a perspective view of an embodiment of an HVAC unit, in accordance with aspects described herein.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
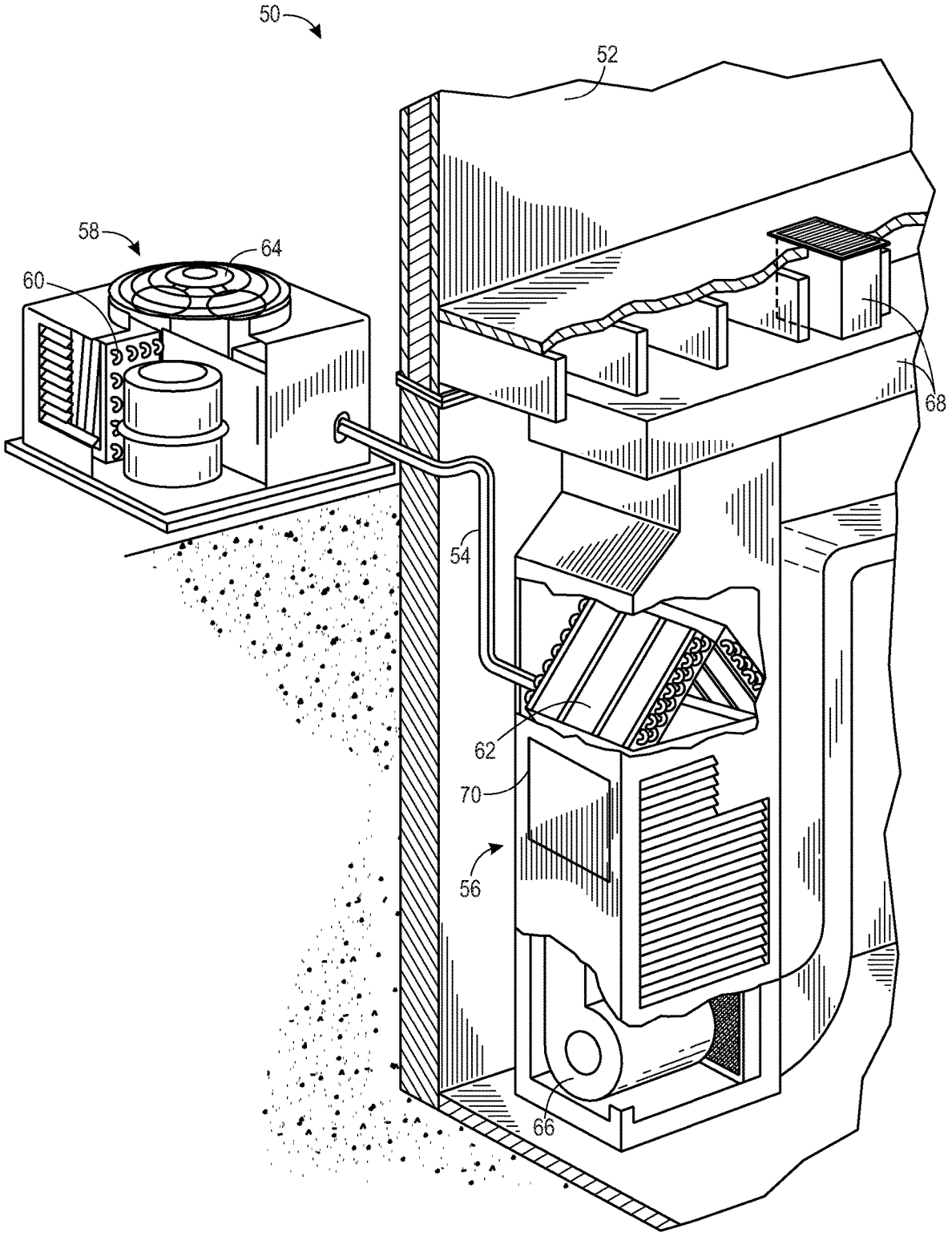
FIG. 3 is a perspective view of an embodiment of a residential HVAC system, in accordance with aspects described herein.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
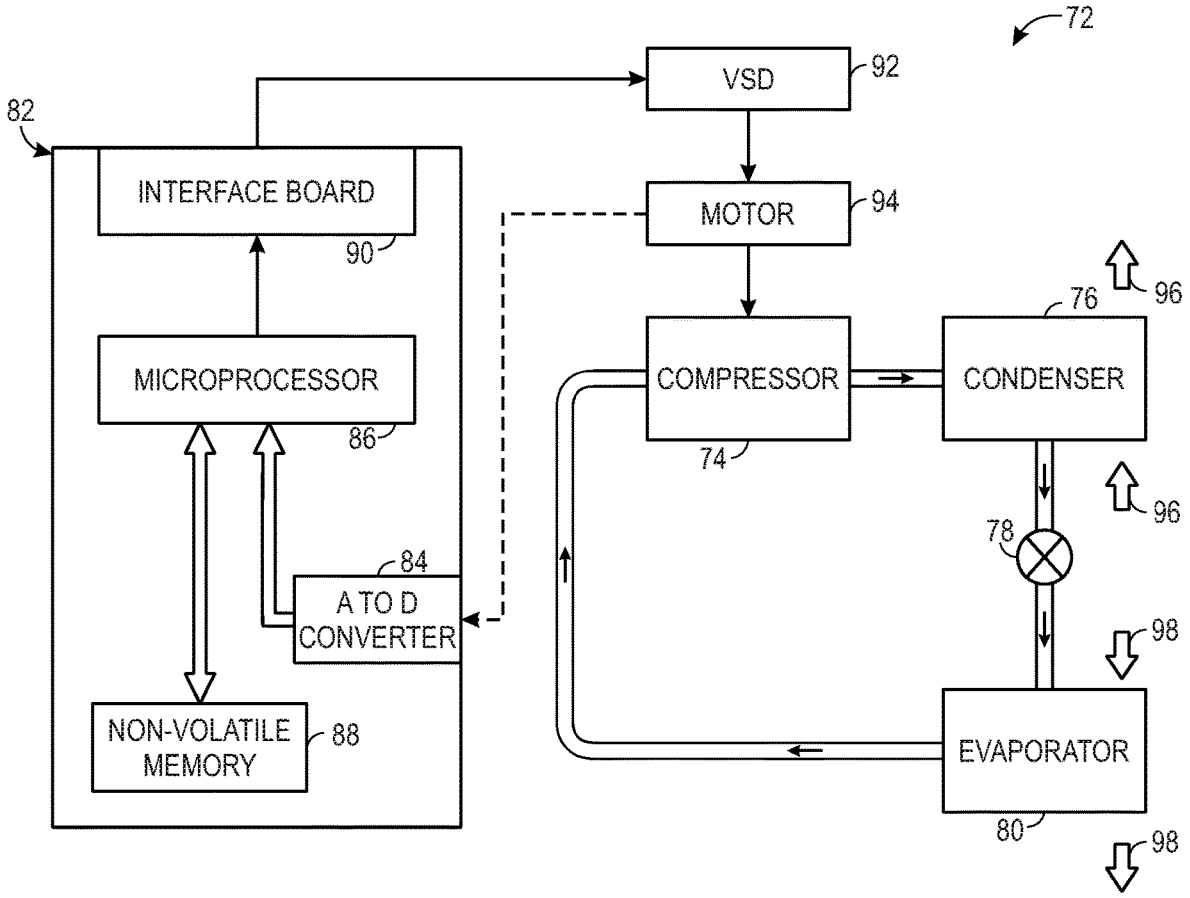
FIG. 4 is a schematic diagram of an embodiment of a vapor compression system that may be used in the HVAC system of FIG. 2 and the residential HVAC system FIG. 3, in accordance with aspects described herein.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator 80 relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed below, HVAC systems may receive separate flows of return air from a conditioned space and outdoor air from a surrounding environment. The return air and outdoor are may be combined to form mixed air, and the mixed air may be conditioned and provided to the conditioned space as conditioned air. In particular, outdoor air may enter one portion or intake of an HVAC unit, and return air may enter a different portion or intake of the HVAC unit, where the two portions or intakes are physically and fluidly separated from one another by a physical barrier, such as a panel. A bypass damper may be included on the panel, that, when opened, enables return air and outdoor air to mix with one another to form mixed air. For instance, when the bypass damper is opened, return air may enter the portion or intake associated with the outdoor air, and the return air and outdoor air may mix to form mixed air. The mixed return air and outdoor air may subsequently pass across a heat exchanger, which is configured to heat, cool, or otherwise condition the mixed air before the mixed air is provided to the conditioned space as conditioned air. As discussed in greater detail below, the bypass damper enables mixing of the return air and outdoor air upstream of the heat exchanger. More particularly, the return air and outdoor air may be mixed, or pre-mixed, upstream of separate return air and outdoor air supply dampers of the HVAC unit that are configured to provide return air and/or outdoor air to the heat exchanger. The pre-mixing of the outdoor air and the return air upstream of the heat exchanger and supply dampers enables a more even distribution of air flow across the heat exchanger and reduces incidence of underutilized portions of the heat exchanger across which a reduced amount of air may flow. In this manner, energy efficiency of the HVAC unit may be improved, pressure drop within the HVAC unit may be reduced, and heating and/or cooling capacity of the heat exchanger may be increased.

Figure 5:
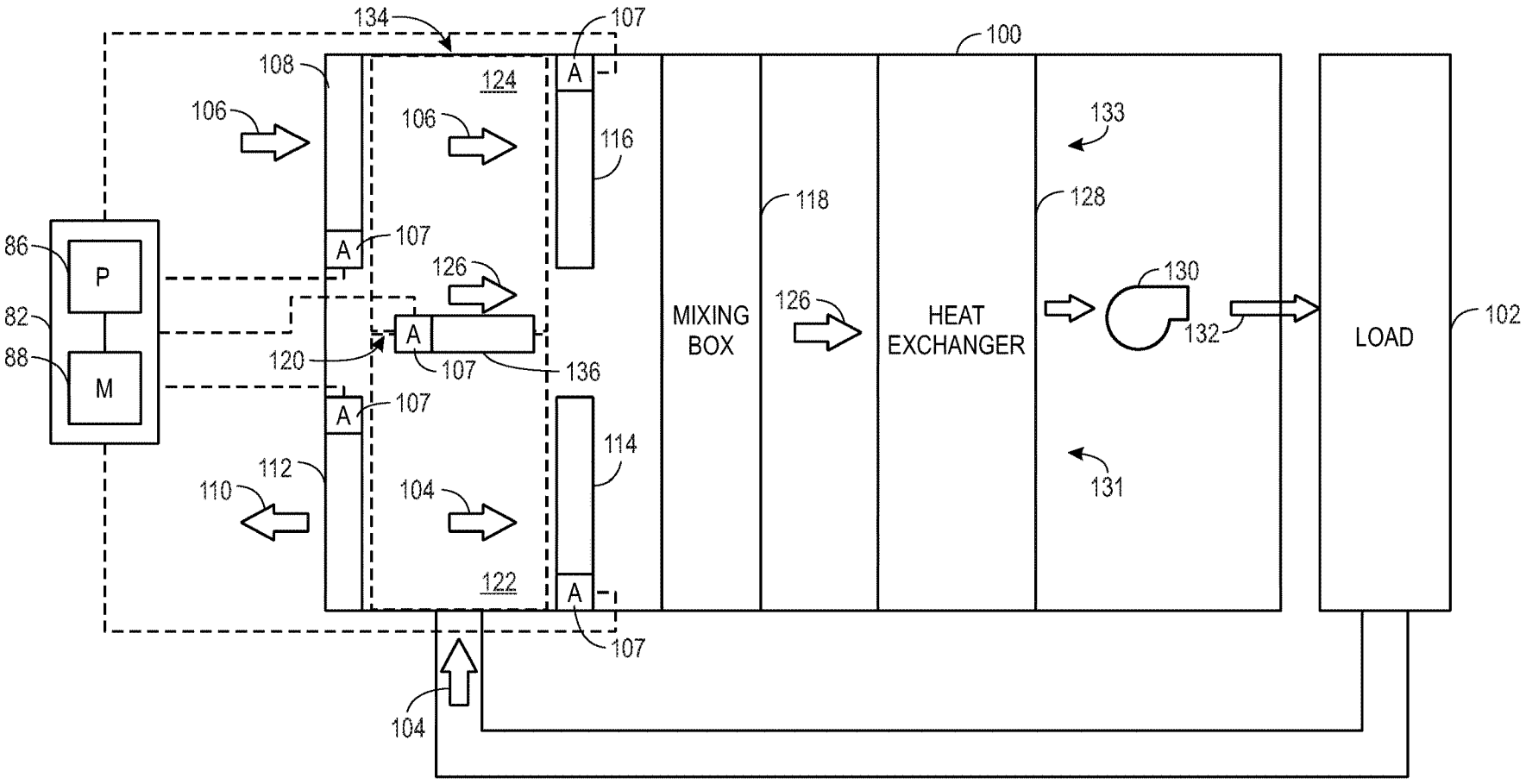
FIG. 5 is a block diagram of an embodiment of an HVAC system, in accordance with aspects described herein.

Continuing with the drawings, FIG. 5 illustrates a block diagram of an HVAC unit 100 that may be included in an HVAC system, such as the HVAC system of FIG. 1. For example, the HVAC unit 100 may be an embodiment of the HVAC unit 12 of FIG. 1. However, in other embodiments, the HVAC unit 100 may be implemented in other types of HVAC systems, such as residential systems, like the residential heating and cooling system 50 of FIG. 3. In general, the HVAC unit 100 may receive air from various sources, condition the received air, and provide conditioned air to a conditioned space, such as a load 102. In particular, the HVAC unit 100 may receive return air 104 from the load 102 and outdoor air 106, which may be environmental air 96, from an environment surrounding the HVAC unit 100.

The HVAC unit 100 may control the intake and output of air via several dampers configured to be actuated between open positions, closed positions, and positions therebetween. Actuation of the dampers enables control of air flow through the HVAC unit 100 and also enables different amounts of different types of air to be combined to form mixed air for conditioning by the HVAC unit 100. For instance, a controller, such as control board 48 of FIG. 2 and/or the control panel 82 of FIG. 4, may be included in the HVAC unit 100, may be communicatively coupled to actuators 107 of the dampers, and may be configured to operate the actuators 107 to position the dampers in respective desired positions that enable desired amounts of air to enter the HVAC unit 100 and enable mixing of different air flows to create mixed air of a desired ratio of air flow types. For instance, the outdoor air 106 may enter the HVAC unit 100 via an opening in the HVAC unit 100 having an outdoor hood damper 108. Additionally, conditioned air from the load 102 may be received by the HVAC unit 100 as return air 104. During certain operations, the HVAC unit 100 may output the return air 104 or a portion of the return air 104 as exhaust air 110 via an exhaust air damper 112 of the HVAC unit 100. Additionally or alternatively, the return air 104 may be re-utilized by the HVAC unit 100 to create conditioned air to provide to the load 102. The outdoor air 106 may also be utilized to create the conditioned air. Indeed, as mentioned above, the return air 104 and outdoor air 106 may be mixed with one another, conditioned, such as via heating or cooling, and then supplied to the load 102 as conditioned air. To this end, the HVAC unit 100 includes a return air damper 114 and an outdoor air damper 116, which may be opened, closed, or otherwise actuated to desired positions to respectively enable the return air 104 and the outdoor air 106 to enter a mixing box 118 of the HVAC unit 100.

In some cases or modes of HVAC unit 100 operation, the outdoor air 106 and the return air 104 may be separated from one another within a portion of the HVAC unit 100. For example, a panel 120 or other physical barrier, such as a wall or divider, of the HVAC unit 100 may initially fluidly separate the outdoor air 106 and the return air 104 entering the HVAC unit 100. In the illustrated embodiment, the return air 104 may enter a return air section 122 of the HVAC unit 100, and the outdoor air 106 may enter an outdoor air section 124 of the HVAC unit 100 that is physically separated from the return air section 122 by the panel 120. In such a case, the outdoor air 106 may flow through outdoor air damper 116 into the mixing box 118, and the return air 104 may flow through return air damper 114 into the mixing box 118. Within the mixing box 118, the outdoor air 106 and return air 104 are combined to form mixed air 126. Generally, the mixing box 118 is an area within the HVAC unit 100 that is positioned between a heat exchanger 128 of the HVAC unit 100, such as the heat exchanger 30 of the HVAC unit 12 of FIG. 2, and the return air section 122 and outdoor air section 124. The mixed air 126 may pass across the heat exchanger 128 to heat or cool the mixed air 126, as desired. For instance, the mixed air 126 may be drawn across the heat exchanger 128 by a supply air fan 130, which may subsequently provide the mixed air 126 as conditioned air 132 to the load 102. More specifically, depending on the operation of the HVAC unit 100, the heat exchanger 128 may function as a condenser, where heat is released from refrigerant within the heat exchanger 128 to heat this mixed air 126, or the heat exchanger 128 may function as an evaporator, in which case the refrigerant in the heat exchanger 128 absorbs heat to cool the mixed air 126. As discussed below, it should also be noted that mixed air 126 may be formed upstream of the mixing box 118.

In some cases, the outdoor air 106 and the return air 104 may remain substantially separated as the outdoor air 106 and the return air 104 pass across the heat exchanger 128. For instance, in some cases, a size of the mixing box 118 may cause the outdoor air 106 and the return air 104 to not completely mix within the mixing box 118 to form the mixed air 126. As a result, the outdoor air 106 and the return air 104 may pass across the heat exchanger 128 separately or substantially separately. In other words, the outdoor air 106 may pass across a first portion of the heat exchanger 128, and the return air 104 may pass across a second, different portion of the heat exchanger 128. For example, in the illustrated embodiment, if the mixing box 118 does not enable adequate mixing of the outdoor air 106 and the return air 104 upstream of the heat exchanger 128, the return air 104 or a substantial portion of the return air 104 may flow primarily across a first portion 131 of the heat exchanger 128, and the outdoor air 106 may flow primarily across a second portion 133 of the heat exchanger 128.

As will be appreciated, when the HVAC unit 100 is operating, the respective quantities of outdoor air 106 and return air 104 utilized by the HVAC unit 100 to create the mixed air 126 and/or conditioned air 132 may differ from one another. For example, by adjusting a position of the outdoor hood damper 108 and/or the outdoor air damper 116, the amount of outdoor air 106 utilized by the HVAC unit 100 may be controlled. Additionally, the amount of the return air 104 that is reconditioned within the HVAC unit 100 may be changed by adjusting a position of the exhaust air damper 112 and/or the return air damper 114. Accordingly, the HVAC unit 100 may produce conditioned air 132 from 100% return air and 0% outdoor air, 0% return air and 100% return air, or any combination of return air 104 and outdoor air 106 therebetween. For instance, in some embodiments, the outdoor air 106 may comprise approximately 10% to 20% of the mixed air 126 and/or conditioned air 132, in which case the return air 104 comprises approximately 80% to 90% of the mixed air 126 and/or conditioned air 132. In such embodiments, the heating and cooling capacity of the heat exchanger 128 may be limited when the outdoor air 106 and return air 104 are unable to adequately mix before passing across the heat exchanger 128. For example, a greater portion of return air 104 air may pass across a portion of the heat exchanger 128, such as the first portion 131, relative to the amount of outdoor air 106 that flows across another portion of the heat exchanger 128, such as the second portion 133.

Bearing this in mind, the HVAC unit 100 enables return air 104 and outdoor air 106 to mix with one another in a pre-mixing box 134 via a bypass damper 136. More specifically, the pre-mixing box 134, which may include all or portions of the return air section 122 and outdoor air section 124, enables return air 104 to be mixed with outdoor air 106 upstream of the heat exchanger 128, as well as the outdoor air damper 116 and the return air damper 114. As shown in the illustrated embodiment, the bypass damper 136 formed in the panel 120 enables utilization of the return air section 122 and/or the outdoor air section 124 as the pre-mixing box 134. The pre-mixing of the return air 104 and the outdoor air 106 in the pre-mixing box 134 improves distribution of the mixed air 126 over the surface area of the heat exchanger 128. As will be appreciated, the improved air distribution across the heat exchanger 128 improves heating and cooling capacity of the heat exchanger 128 and increases energy efficiency of the HVAC unit 100. Improvements in heat exchanger 128 operation and HVAC unit 100 efficiency may be particularly notable in compact embodiments of the HVAC unit 100, such as embodiments in which the mixing box 118 is inadequately sized to sufficiently mix the return air 104 and the outdoor air 106 upstream of the heat exchanger 128.

As illustrated, the bypass damper 136 may be a portion of the panel 120. In other embodiments, the bypass damper 136 may define all or substantially all of the panel 120. The bypass damper 136 may have a variety of different configurations to enable control of airflow across the bypass damper 136 and between the return air section 122 and the outdoor air section 124. For example, the bypass damper 136 may include a louver system with one or more slats that may be adjusted, such as rotationally, to open and/or close an airflow passage across the bypass damper 136. For example, a position of one or more slats of the louver system may be adjusted by the control panel 82 via the actuator 107 associated with the bypass damper 136. As another example, the bypass damper 136 may include one or more panels, sheets, blades, boards, flaps, layers, or other components that actuatably slide, rotate, or otherwise move, such as move relative to one another, in order to open and close an airflow passage across the bypass damper 136. In another embodiment, the bypass damper 136 may include a valve, a gate, or other suitable airflow regulation component to enable and disable airflow between the return air section 122 and the outdoor air section 124. Moreover, in certain embodiments, the bypass damper 136 may span the entire width of the return air section 122 and/or the outdoor air section 124.

In operation, the bypass damper 136 may be opened, closed, or otherwise positioned to a desired position by control circuitry, such as the control panel 82, associated with the HVAC unit 100. For instance, the control panel 82 may control the operation of the actuator 107 associated with the bypass damper 136 to position the bypass damper 136 in a desired position. When in an open position, such as a position in which the bypass damper 136 is completely or partially opened, return air 104 may pass from the return air section 122 into the outdoor air section 124. In the outdoor air section 124, the return air 104 may mix with the outdoor air 106 to form the mixed air 126 within the outdoor air section 124. Thereafter, the mixed air 126 within the outdoor air section 124 may be supplied to the mixing box 118 and the heat exchanger 128 via the outdoor air damper 116. Additionally, outdoor air 106 may pass from the outdoor air section 124 into the return air section 122 and mix with return air 104 to form the mixed air 126 in the return air section 122. Thereafter, the mixed air 126 within the return air section 122 may be supplied to the mixing box 118 and the heat exchanger 128 via the return air damper 114. In any case, the control panel 82 may control the operation of the actuators 107 associated with the outdoor air damper 116 and the return air damper 114 to control the amount of mixed air 126 provided to the heat exchanger 128. For instance, when mixed air is formed in the outdoor air section 124, the control panel 82 may adjust an operation of the actuator 107 associated with the outdoor air damper 116 to control the amount of mixed air 126 that is provided from the outdoor air section 124 to the heat exchanger 128.

Figure 6:
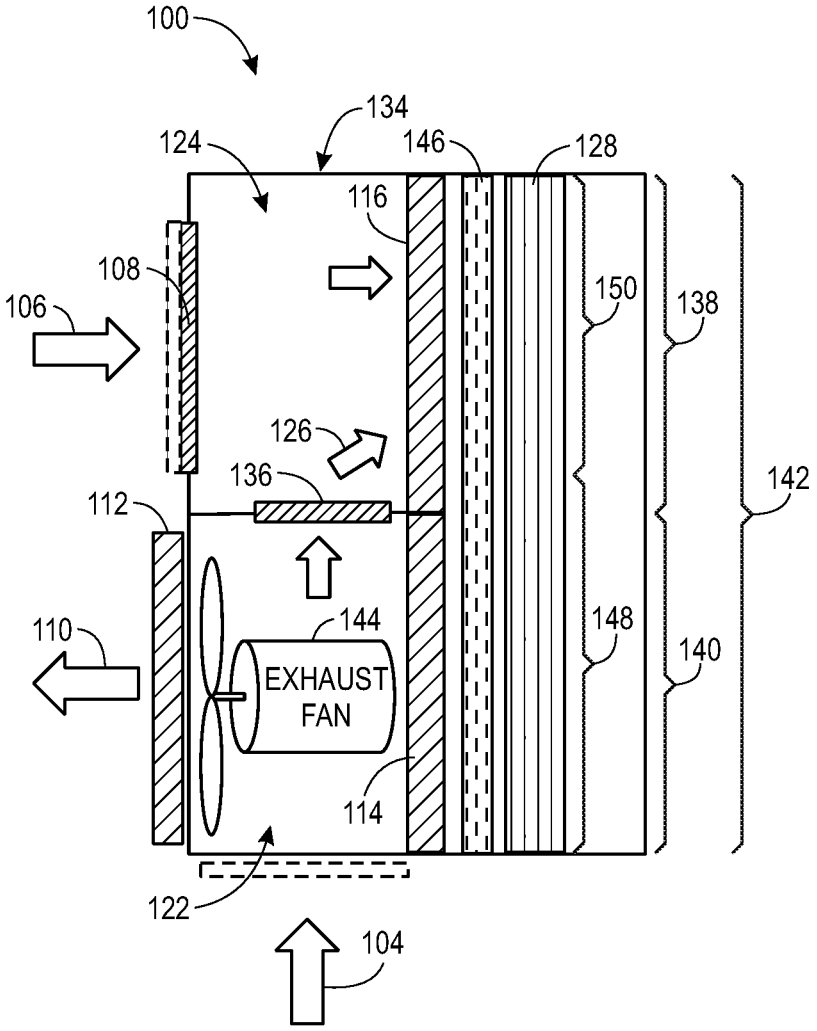
FIG. 6 is a side view of a schematic diagram of an embodiment of a portion of an HVAC system, in accordance with aspects described herein.

The formation of the mixed air 126 upstream of the outdoor air damper 116, the return air damper 114, the mixing box 118, and the heat exchanger 128, enables relatively equal amounts of air flow to be provided from the return air section 122 and the outdoor air section 124 to the heat exchanger 128. By providing relatively even air flows to the heat exchanger 128, the mixed air 126 may pass over a greater surface area of the heat exchanger 128 and/or pass over the heat exchanger 128 in a more evenly distributed manner, which may result in higher energy efficiency of the HVAC unit 100 and increased heating and cooling capacity of the heat exchanger 128. To help illustrate this, FIG. 6 is a side view of a schematic diagram of an embodiment of a portion of the HVAC unit 100. As illustrated, the HVAC unit 100 of FIG. 6 includes several components discussed above with respect to FIG. 5, such as the outdoor hood damper 108, the exhaust air damper 112, the outdoor air damper 116, the bypass damper 136, and the heat exchanger 128. Additionally, the illustrated HVAC unit 100 includes the return air section 122 and the outdoor air section 124. Furthermore, the outdoor air section 124 may have a first height or dimension 138, the return air section 122 may have second height or dimension 140, and the heat exchanger 128 may span a total height or dimension 142 that is equal to or substantially equal to the sum of the first height 138 and the second height 140.

The HVAC unit 100 may also include an exhaust air fan 144, which may be disposed within the return air section 122 and is configured to motivate return air 104 to exit the HVAC unit 100 as exhaust air 110. Moreover, the HVAC unit 100 may include one or more air filters, such as air filter 146, which may remove particulates and contaminants from return air 104, outdoor air 106, and/or mixed air 126.

As discussed above, during operation of the HVAC unit 100, depending on the position of the bypass damper 136, the amount of airflow passing over one portion of the heat exchanger 128 may be greater or significantly greater than an amount of airflow passing over another portion of the heat exchanger 128. For example, if the bypass damper 136 is in a fully closed position and the HVAC unit 100 is operating to utilize 80% return air 104 and 20% outdoor air 106 to form the mixed air 126, a larger amount of air, which may be predominantly the 80% return air 104, may pass across a first airflow region 148 of the heat exchanger 128 compared to an amount of air, which may be predominantly the 20% outdoor air 106, passing across a second airflow region 150 of the heat exchanger 128. However, by opening the bypass damper 136 to a partially or fully opened position, return air 104 may enter the outdoor air section 124, mix with the outdoor air 106 to form mixed air 126, and the mixed air 126 may pass across the heat exchanger 128 via the outdoor air damper 116. In such as case, the mixed air 126 may generally pass over the second airflow region 150 of the heat exchanger 128, which may result in relatively more air passing across the second airflow region 150. Moreover, because some of the return air 104 exits the return air section 122 to flow into the outdoor air section 124 via the bypass damper 136, less return air 104 may pass over the first airflow region 148 of the heat exchanger 128 via the return air damper 114. Accordingly, relatively even amounts of air may pass across both the first airflow region 148 and the second airflow region 150 by using the bypass damper 136. By providing more even air flow across the total dimension 142 of the heat exchanger 128, the HVAC unit 100 may operate with greater energy efficiency compared to when the bypass damper 136 is fully closed or not included with the HVAC unit 100. Additionally, the heat exchanger 128 may operate with increased heating and cooling capacity.

Furthermore, it should be noted that while the example discussed above discusses return air 104 passing into the outdoor air section 124 via the bypass damper 136 to form mixed air 126 before passing through the outdoor air damper 116 and across the heat exchanger 128, in other embodiments, outdoor air 106 may pass into the return air section 122 via the bypass damper 136 to form mixed air 126. For example, when the HVAC unit 100 operates to provide conditioned air 132 by utilizing more outdoor air 106 than return air 104, outdoor air 106 may enter the return air section 122 via the bypass damper 136, mix with return air 104 to form mixed air 126, and pass across the first airflow region 148 of the heat exchanger 128 via the return air damper 114.

Additionally, it should be noted that while the HVAC unit 100 is discussed as providing mixed air 126 across the heat exchanger 128, in some embodiments, mixed air 126 may not be used. For example, in embodiments in which the HVAC unit 100 operates using purely return air 104 or purely outdoor air 106, mixed air 126 may be not be formed. In such embodiments, air may pass from an input section of the HVAC unit 100, through an opening in the panel 120 provided by the bypass damper 136, and into another section of the HVAC unit 100 before passing across the heat exchanger 128 via the return air damper 114 or the outdoor air damper 116. For example, when the outdoor hood damper 108 is completely closed, no outdoor air 106 flows into the HVAC unit 100. In such circumstances, the HVAC unit 100 may utilize purely return air 104. In such an embodiment, a portion of the return air 104 entering the HVAC unit 100 may exit the return air section 122 via the return air damper 114 and pass across the heat exchanger 128, while another portion of the return air 104 may enter the outdoor air section 124 and exit the outdoor air section 124 via the outdoor air damper 116 before passing across the heat exchanger 128.

The degree to which the bypass damper 136, as well as the other dampers of the HVAC unit 100, may be opened, closed, or otherwise positioned may be controlled by a controller, such as the control panel 82. In particular, a position of the bypass damper 136 may be controlled based on the position of other dampers in the HVAC unit 100, such as any of the dampers discussed herein, and/or based on desired amounts of return air 104 and outdoor air 106 to be utilized by the HVAC unit 100 for production of the conditioned air 132. For example, when the HVAC unit 100 is operating using approximately equal amounts of outdoor air 106 and return air 104, the bypass damper 136 may be closed. However, when the amount of return air 104 and the amount of outdoor air 106 are unequal, the bypass damper 136 may be opened based on a difference in the respective amounts of return air 104 and outdoor air 106 being utilized. In some embodiments, as the difference between the respective amounts of return air 104 and outdoor air 106 grows, the bypass damper 136 may be opened to a greater degree. As another example, the control panel 82 may determine the position of the bypass damper 136 based on the position of the outdoor hood damper 108. As yet another example, the control panel 82, which may control an amount of exhaust air 110 provided via the exhaust air damper 112, may control the position of the bypass damper 136 based on the position of the exhaust air damper 112.

It should also be noted that the embodiment of the HVAC unit 100 shown in FIG. 6 does not include a mixing box, such as the mixing box 118 of FIG. 5. That is, the air filter 146 and the heat exchanger 128 may be adjacent or directly adjacent to one another within the HVAC unit 100 and/or directly adjacent to one or both of the outdoor air damper 116 and return air damper 114. In other words, in some embodiments, the mixing of the return air 104 and the outdoor air 106 within the pre-mixing box 134 via the bypass damper 136 may be sufficient to justify removal of the mixing box 118 from the HVAC unit 100. As will be appreciated, removal of the mixing box 118 may enable a smaller and more compact HVAC unit 100 footprint and/or may enable more lightweight HVAC units 100.

Figure 7:
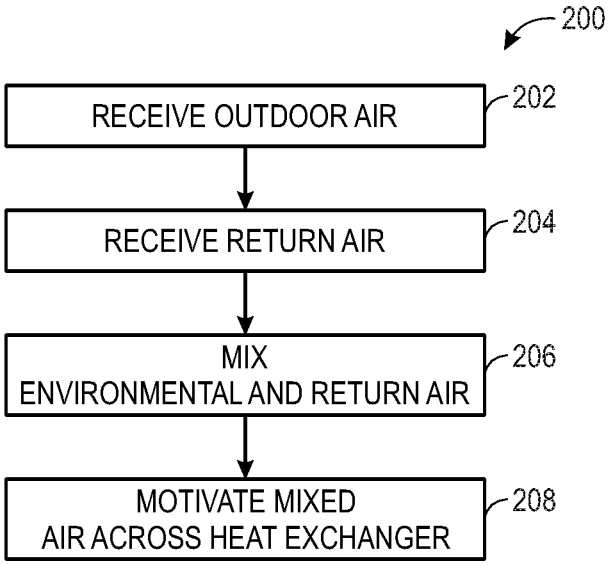
FIG. 7 is a flow diagram of an embodiment of a process for operating an HVAC system, in accordance with aspects described herein.

Keeping the discussion of FIG. 5 and FIG. 6 in mind, FIG. 7 is a flow diagram of a process 200 for operating an HVAC system. The process 200 may be implemented by an HVAC unit such as the HVAC unit 100 or any other HVAC system having the bypass damper 136.

At block 202, the HVAC unit 100 may receive outdoor air 106. For instance, as described above, the outdoor hood damper 108 of the HVAC unit 100 may be opened to enable outdoor air 106 to enter the outdoor air section 124 of the HVAC unit 100.

At block 204, the HVAC unit 100 may receive return air 104. For example, return air 104 may be provided to the return air section 122 of the HVAC unit 100 via ductwork, such as ductwork 14, of a space to which the HVAC unit 100 supplies conditioned air.

At block 206, the HVAC unit 100 may mix the outdoor air 106 and the return air 104 to create mixed air 126. As described above, mixing may occur in the pre-mixing box 134 of the HVAC unit 100. In other words, mixing of the outdoor air 106 and the return air 104 may occur within the HVAC unit 100 before air exits the return air section 122 and outdoor air section 124 and passes toward the heat exchanger 128 of the HVAC unit 100. For instance, by opening the bypass damper 136 that may be included in the panel 120 that separates the return air section 122 and the outdoor air section 124, return air 104 may enter the outdoor air section 124 and mix with the outdoor air 106 to create the mixed air 126. The mixed air 126 generated within the outdoor air section 124 may then exit the outdoor air section 124 via the outdoor air damper 116. As another example, the outdoor air 106 may enter the return air section 122 via the bypass damper 136 and mix with return air 104 to create the mixed air 126. The mixed air 126 generated within the return air section 122 may then exit the return air section 122 via the return air damper 114.

At block 208, the HVAC unit 100 may motivate the mixture of outdoor air 106 and return air 104 across the heat exchanger 128 of the HVAC unit 100. For example, the mixed air 126 may be drawn across the heat exchanger 128 via the supply air fan 130 of the HVAC unit 100 to condition the mixed air 126 and produced conditioned air 132. The supply air fan 130 then provides the conditioned air 132 to the load 102, such as a building or other conditioned space, serviced by the HVAC unit 100.

Accordingly, the present disclosure is directed to an HVAC system that enables improved distribution of airflow across portions of a heat exchanger within the HVAC system. For example, a bypass damper may be opened, closed, or otherwise positioned to enable air flow between one inlet section and another inlet section of an HVAC unit to pre-mix air before it is provided to a heat exchanger of the HVAC unit. The pre-mixing of air flows via the bypass damper enables more even amounts of mixed air flow to be provided across portions of the heat exchanger associated with the inlet sections of the HVAC unit. As such, the presently disclosed furnace system may provide enhanced energy efficiency and increased heating and cooling capacity of the HVAC unit.

While only certain features and embodiments of the present disclosure have been illustrated and described, many modifications and changes may occur to those skilled in the art, such as variations in sizes, dimensions, structures, shapes and proportions of the various elements, values of parameters, including temperatures, pressures, and so forth, mounting arrangements, use of materials, colors, orientations, and the like, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a return air section of an HVAC unit configured to receive a return airflow from a conditioned space;

an outdoor air section of the HVAC unit configured to receive an outdoor airflow from an environment surrounding the HVAC unit, wherein the return air section and the outdoor air section are configured to discharge airflow toward a mixing box of the HVAC unit in parallel with one another;

a heat exchanger positioned within the HVAC unit and downstream of the mixing box relative to a flow direction of airflow in the HVAC unit; and a panel dividing the return air section and the outdoor air section, wherein the panel comprises a bypass damper actuatable to enable mixing of the return airflow and the outdoor airflow to produce a mixed airflow in the outdoor air section.

2. The HVAC system of claim 1, wherein the outdoor air section comprises a damper configured to selectively control flow rate of the outdoor airflow from the environment into the outdoor air section.

3. The HVAC system of claim 2, comprising an exhaust fan of the return air section configured to drive a portion of the return airflow out of the return air section and into the environment.

4. The HVAC system of claim 1, wherein the heat exchanger is an evaporator coil.

5. The HVAC system of claim 4, wherein the outdoor air section comprises a first height, the return air section comprises a second height, and the evaporator coil spans a total height comprising a sum of the first height and the second height.

6. The HVAC system of claim 4, wherein the evaporator coil comprises a first portion corresponding to the return air section and a second portion corresponding to the outdoor air section, wherein the HVAC system is configured to adjust a position of the bypass damper such that substantially equal amounts of airflow are provided across the first portion and the second portion of the evaporator coil.

7. The HVAC system of claim 1, wherein the outdoor air section comprises a damper configured to selectively control flow rate of airflow from the outdoor air section to the heat exchanger of the HVAC unit.

8. The HVAC system of claim 1, wherein the return air section comprises a damper configured to selectively control flow rate of airflow from the return air section to the heat exchanger of the HVAC unit.

9. The HVAC system of claim 1, comprising a filter disposed within the HVAC unit downstream of the return air section and the outdoor air section relative to the flow direction of airflow in the HVAC unit.

10. The HVAC system of claim 1, wherein the mixing box of the HVAC unit is positioned downstream of the outdoor air section and the return air section relative to the flow direction of airflow in the HVAC unit.

11. A heating, ventilation, and/or air conditioning (HVAC) unit, comprising:

a refrigerant circuit comprising a heat exchanger and configured to flow a refrigerant therethrough;

a return air section comprising a return air inlet configured to receive a return airflow from a conditioned space and a return air outlet configured to output airflow toward the heat exchanger;

an outdoor air section comprising an outdoor air inlet configured to receive an outdoor airflow from an environment surrounding the HVAC unit and an outdoor air outlet configured to output airflow toward the heat exchanger wherein the return air outlet and the outdoor air outlet are configured to output airflow toward the heat exchanger in parallel with one another; and a panel dividing the return air section and the outdoor air section, wherein the panel comprises a bypass damper actuatable to fluidly couple the outdoor air section and the return air section and enable mixing of the outdoor airflow and the return airflow within the outdoor air section, the return air section, or both, to produce a mixed airflow.

12. The HVAC unit of claim 11, wherein the HVAC unit comprises a rooftop unit having the refrigerant circuit, the return air section, the outdoor air section, and the panel.

13. The HVAC unit of claim 11, comprising an actuator configured to adjust a position of the bypass damper and a controller configured to adjust operation of the actuator.

14. The HVAC unit of claim 13, comprising an outdoor air damper actuatable to control an amount of the outdoor airflow that enters the HVAC unit from the environment, wherein the controller is configured to adjust the position of the bypass damper based on a position of the outdoor air damper.

15. The HVAC unit of claim 13, comprising:

a return air damper actuatable to control an amount of airflow passing from the return air section toward the heat exchanger;

an outdoor air damper actuatable to control an amount of airflow passing from the outdoor air section toward the heat exchanger; and a mixing box disposed downstream of the return air section and the outdoor air section and upstream of the heat exchanger relative to a flow direction of airflow in the HVAC unit.

16. The HVAC unit of claim 11, comprising an air filter of the HVAC unit, wherein the air filter is positioned downstream of the return air section and the outdoor air section and upstream of the heat exchanger relative to a flow direction of airflow in the HVAC unit.

17. The HVAC unit of claim 11, comprising an exhaust air damper actuatable to control an amount of an exhaust airflow that exits the return air section to the environment, wherein a controller of the HVAC unit is configured to adjust a position of the bypass damper based on a position of the exhaust air damper.

18. A heating, ventilation, and/or air conditioning (HVAC) unit, comprising:

a heat exchanger;

a pre-mixing section comprising a return air section configured to receive a return airflow from a conditioned space and comprising an outdoor air section configured to receive an outdoor airflow from an environment surrounding the HVAC unit, wherein the return air section and the outdoor air section are configured to discharge airflow toward the heat exchanger in parallel; and a panel disposed within the pre-mixing section and dividing the return air section and the outdoor air section, wherein the panel comprises a bypass damper actuatable to enable the return airflow to enter the outdoor air section, the outdoor airflow to enter the return air section, or both, wherein the HVAC unit is configured to mix the return airflow and the outdoor airflow within the pre-mixing section to form a mixed airflow and provide the mixed airflow to the conditioned space.

19. The HVAC unit of claim 18, wherein the heat exchanger is disposed downstream of the pre-mixing section, wherein the heat exchanger is configured to condition the mixed airflow for the conditioned space.

20. The HVAC unit of claim 19, comprising an air filter disposed between the pre-mixing section and the heat exchanger.

21. The HVAC unit of claim 19, wherein a first portion of the heat exchanger spans a height of the return air section, and a second portion of the heat exchanger spans a height of the outdoor air section.

22. The HVAC unit of claim 18, comprising a return air damper of the return air section and an outdoor air damper of the outdoor air section, wherein the return air damper and the outdoor air damper are each configured to regulate flow of the mixed airflow exiting the pre-mixing section.

23. The HVAC unit of claim 18, wherein the HVAC unit is configured to mix the return airflow and the outdoor airflow within the outdoor air section to form the mixed airflow within the outdoor air section.

24. The HVAC unit of claim 18, comprising:

an actuator configured to adjust a position of the bypass damper; and a controller configured to adjust operation of the actuator.

25. The HVAC unit of claim 24, wherein the controller is configured to adjust the position of the bypass damper based on a position of another damper of the HVAC unit.

* * * * *